United States Patent [19]

Ankum et al.

[11] Patent Number: 4,799,291

[45] Date of Patent: Jan. 24, 1989

[54] SELF-ALIGNING HINGE

[75] Inventors: Robert H. Ankum, Davenport, Iowa; Jay H. Olson, Rock Island, Ill.

[73] Assignee: Deere & Company, Moline, Ill.

[21] Appl. No.: 546,833

[22] Filed: Oct. 31, 1983

[51] Int. Cl.[4] ..... E05D 7/10

[52] U.S. Cl. ..... 16/259; 16/267; 16/381

[58] Field of Search ..... 16/254, 257, 258, 259, 16/267, 321, 380, 381

[56] References Cited

U.S. PATENT DOCUMENTS

| | | | |
|---|---|---|---|
| 2,205,969 | 6/1940 | Boenecke | 16/259 |
| 2,429,447 | 10/1947 | Apfelbaum | 16/171 |
| 2,497,337 | 2/1950 | Ackerman | 16/172 |
| 2,538,372 | 1/1951 | Light | 16/380 X |
| 2,975,491 | 3/1961 | Paul et al. | 16/267 X |
| 4,153,347 | 5/1979 | Myer | 16/259 X |
| 4,179,844 | 12/1979 | Steuer | 16/171 |
| 4,343,253 | 8/1982 | Ianarone | 16/259 X |
| 4,358,871 | 11/1982 | Takai | 16/267 X |

FOREIGN PATENT DOCUMENTS

| | | | |
|---|---|---|---|
| 21793 | of 1900 | United Kingdom | 16/381 |
| 461575 | 2/1937 | United Kingdom | 16/259 |

*Primary Examiner*—Fred A. Silverberg

[57] ABSTRACT

Self-aligning hinge for providing a properly aligned, uniformly tight fit between opposite mating first and second members has a resilient element in the form of a wire spring for permitting restrained movement of a hinge in all directions. The wire spring which is generally U-shaped has an intermediate portion residing within a groove in a mounting post extending outwardly from the first member and opposite end portions which encircle the opposite ends of a hinge pin. The pin resides within slots within an opposite pair of lugs mounted on the first member and within a hole in a single lug disposed between the spaced-apart pair of lugs and mounted on the second member.

12 Claims, 4 Drawing Sheets

SELF-ALIGNING HINGE

BACKGROUND OF THE INVENTION

1. Field of the Invention

The present invention relates to hinges, and more particularly to hinges which permit resiliently restrained movement in one or more directions other than about the hinging pin thereof to provide a properly aligned, uniformly tight fit between opposite mating members.

2. History of the Prior Art

It is sometimes necessary to couple together a pair of opposite, mating members with a hinge so that the members can be separated from one another through the hinging action of the hinge. This may be true, for example, in the case of a housing made up of opposite halves where the hinged mounting of the two halves is necessary in order to be able to open the housing to provide access to the interior thereof. In such arrangements it may be difficult to maintain a tight fit between the opposite halves of the housing around the entire circumference thereof, particularly with a hinge of conventional rigid design. The problem of properly aligning and providing a uniform tight fit between the opposite halves of the housing may be aggravated by such factors as manufacturing tolerances or the build up of dirt or other foreign objects between the mating halves of the housing.

An example of a structure in which such problems arise is provided by a co-pending application of Lundie et al, Ser. No. 546,834, filed Oct. 31, 1983 and commonly assigned with the present application. The Lundie et al application describes a vacuum seed meter which has a generally cylindrical housing comprised of opposite mating half shells. The opposite half shells of the housing must be coupled together with a hinge so that access can be provided to the interior of the housing for various reasons including the changing of a rotatable seed disk mounted within the housing. When the mating half shells of the housing are pivoted toward each other and then clamped together to close the housing, it is necessary that the half shells properly align with each other upon closing and that they form a uniform tight fit about the entire circumference thereof. Such a fit can be provided using a conventional hinge of rigid, inflexible design such as that shown in U.S. Pat. No. 2,429,447 of Apfelbaum if the mating half shells of the housing are precisely manufactured to within very close tolerances. However, this has been found to be impractical because of the time and expense involved in achieving the necessary tolerances. Moreover, a buildup of dirt and debris within the individual half shells at or adjacent the interface therebetween makes precise alignment and a uniform tight fit difficult or impossible to achieve, even in instances where close manufacturing tolerances are observed.

Such problems suggest the use of a resilientlty movable, self-aligning hinge in order that proper alignment and the desired uniform fit may be achieved in the face of more practical lowered manufacturing tolerances as well as in the face of other problems created such as by the buildup of dirt and debris. However, the prior art has been devoid of a suitable hinge for accomplishing this. While hinges having some resiliency are known, as shown for example by U.S. Pat. No. 4,179,844 of Steuer, such hinges are designed for different types of applications or in any event do not possess the necessary characteristics.

Accordingly, it would be desirable to provide an improved hinge. It would furthermore be desirable to provide an improved hinge useful in providing proper alignment and a uniform tight fit between opposite mating members in the face of manufacturing tolerances and other potential problems such as the buildup of dirt and debris. It would still furthermore be desirable to provide a self-aligning hinge capable of moving in various different directions against resilient resistance to facilitate proper alignment and a uniform tight fit between opposite mating members such as the opposite half shells of the generally cylindrical housing of the vacuum seed meter described in the previously referred to co-pending application of Lundie et al.

BRIEF DESCRIPTION OF THE INVENTION

Briefly, the present invention provides an improved hinge capable of moving in various different directions against a resilient resistance to facilitate self-alignment and a uniform tight fit between opposite mating members.

In a preferred embodiment of such a hinge the resilient resistance is provided by a spring coupled between a hinge pin for the hinge and a first one of the opposite mating members. The pin resides within openings in a plurality of lugs mounted on the opposite mating members. A pair of spaced-apart lugs mounted on the first member have slots therein for receiving the pin, which slots open at a first side of each of the lugs. A single lug mounted on the opposite second member is disposed between the pair of spaced-apart lugs and has a hole therein for receiving the pin. The spring is comprised of a generally U-shaped resilient wire having loops at the opposite ends thereof which encircle the opposite ends of the pin and an intermediate portion which is coupled to the first member by a mounting post mounted on the first member and having a groove therein for receiving the intermediate portion of the resilient wire. The mounting post and the associated intermediate portion of the resilient wire are disposed opposite the first sides of the spaced-apart pair of lugs and adjacent the single lug mounted on the second member.

The slots within the spaced-apart pair of lugs mounted on the first member receive the pin in relatively loose fashion so as to permit considerable movement of the pin and the single lug which is mounted on the second member relative thereto in a variety of different directions under the resistance of the spring. Such movement is a self-aligning feature which provides for proper alignment of the opposite first and second members as the first and second members are closed upon each other. The resiliently flexible nature of the spring permits some movement of the pair of spaced-apart lugs mounted on the first member in a direction away from the single lug mounted on the second member to permit a relatively uniform light fit between the first and second members about the entire peripheries thereof. The opposite first and second members together with the spring may be designed so as to hold the spring slightly flexed and therefore in tension when the opposite first and second members are tightly fitted onto each other, the tension thereafter serving to maintain such tight fit. The spring tension biases the pin against the spaced-apart pair of lugs to eliminate slop between the pin and the first member, thereby eliminating half the tolerance which is present in most hinge designs.

BRIEF DESCRIPTION OF THE DRAWINGS

The foregoing and other objects, features and advantages of the invention will be apparent from the following more particular description of a preferred embodiment of the invention, as illustrated in the accompanying drawings, in which.

DETAILED DESCRIPTION

Figure 1:
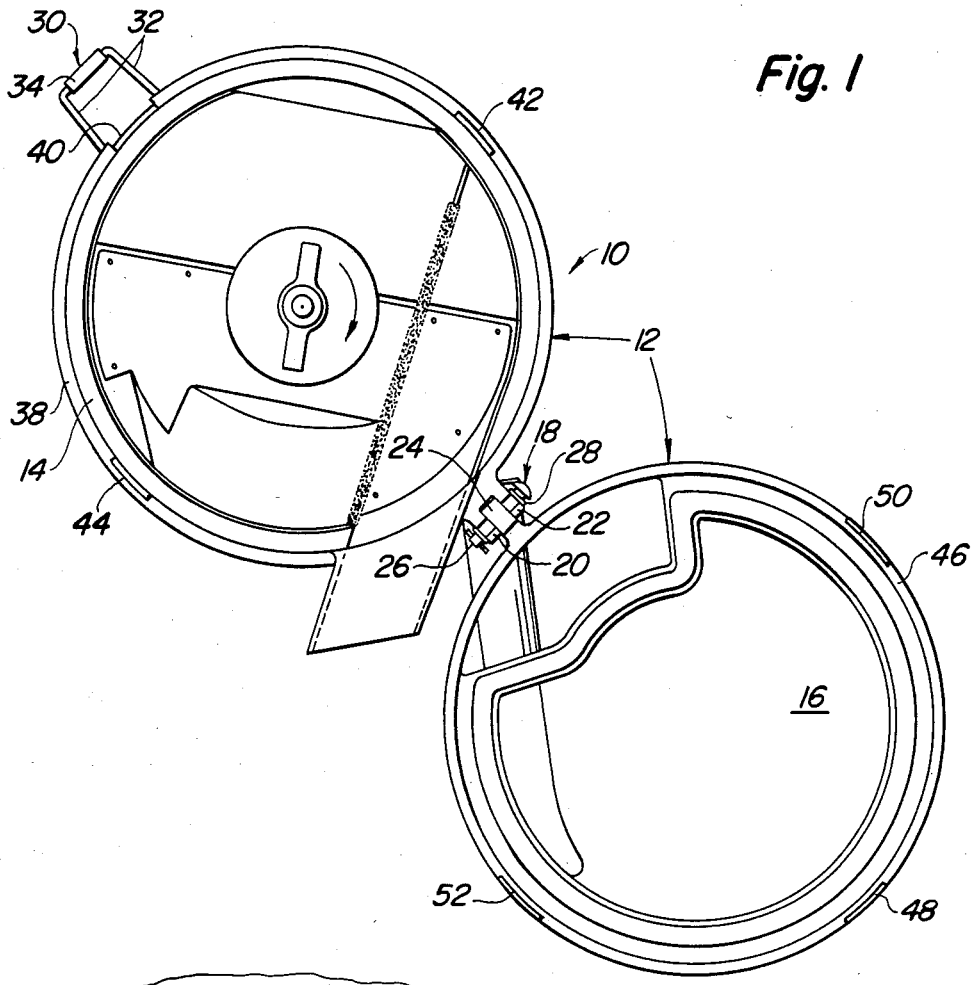
FIG. 1 is a front view of a vacuum seed meter in which the two half shells of the generally cylindrical housing are joined by a self-aligning hinge in accordance with the invention.
Figure 4:
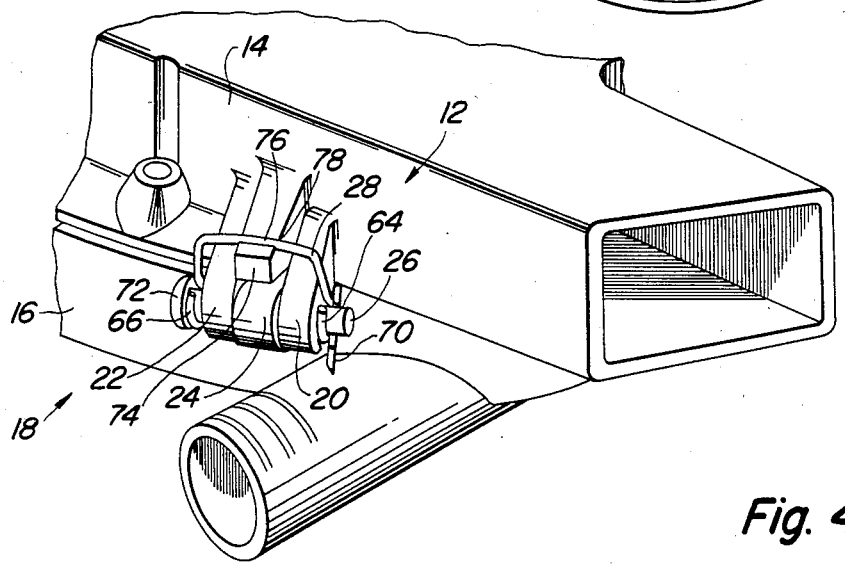
FIG. 4 is a perspective view of a portion of the vacuum seed meter of FIG. 1 showing the hinge in greater detail.
Figure 2:
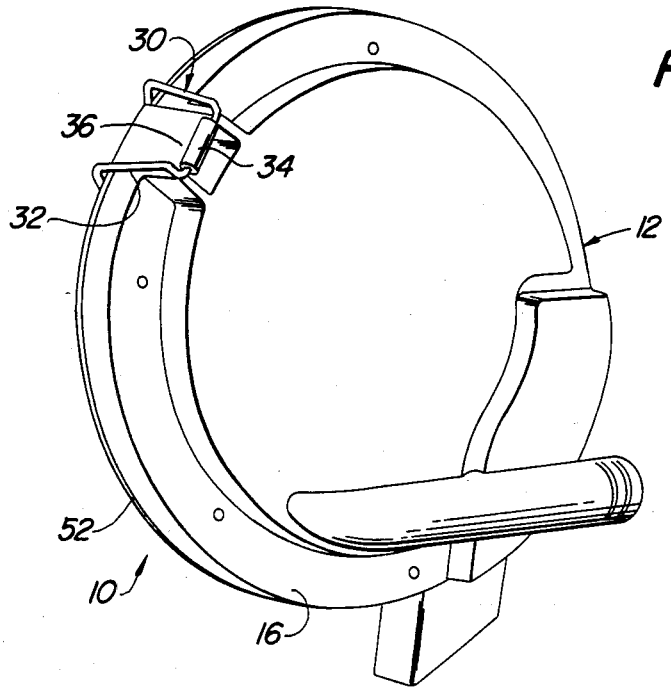
FIG. 2 is a left front perspective view of the vacuum seed meter of FIG. 1 with the generally cylindrical housing thereof held in a closed position by a clasp.
Figure 3:
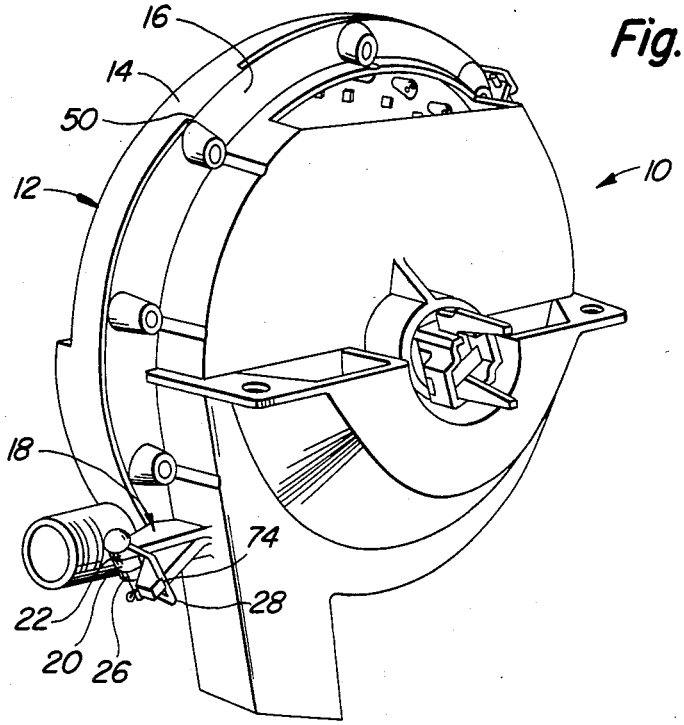
FIG. 3 is a right rear perspective view of the vacuum seed meter of FIG. 1 with the generally cylindrical housing thereof in the closed position and showing the selfaligning hinge in accordance with the invention.
Figure 5:
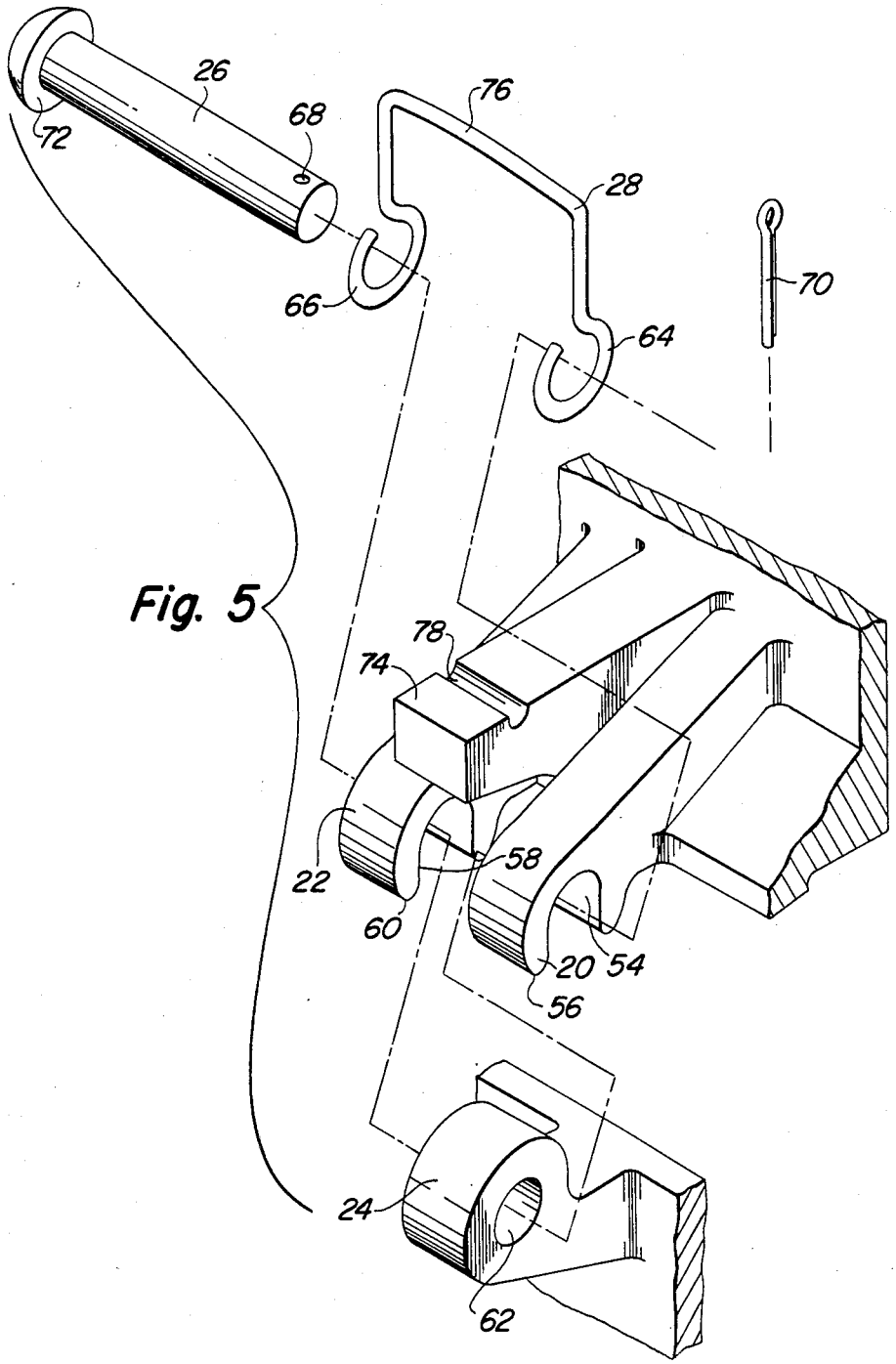
FIG. 5 is a perspective view of the hinge similar to that of FIG. 4 but with the various parts of the hinge exploded to illustrate their interrelationship.
Figure 6:
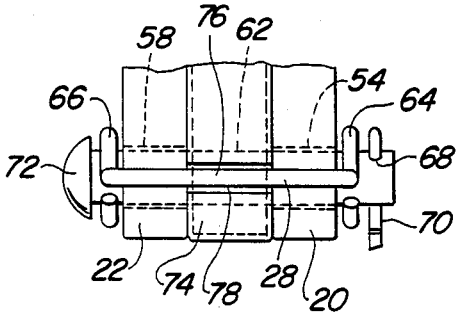
FIG. 6 is a top view of the hinge as seen in the perspective view of FIG. 4.
Figure 7:
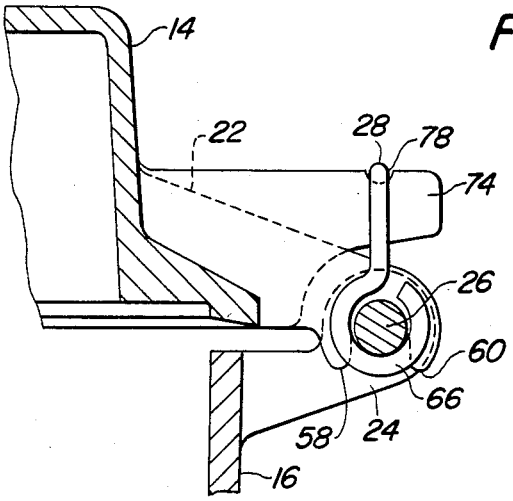
FIG. 7 is a left side view of the hinge as seen in the perspective view of FIG. 4.
Figure 8:
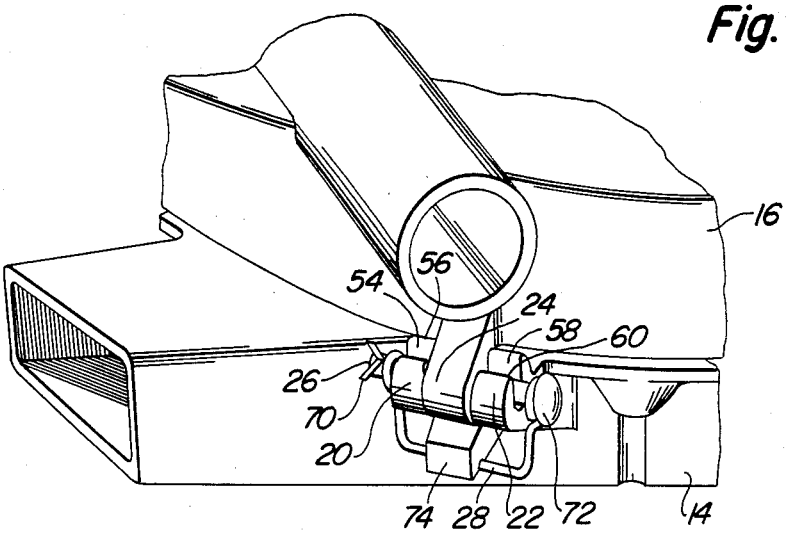
FIG. 8 is a perspective view of a portion of the vacuum seed meter of FIG. 1 from an angle different from the view of FIG. 4 in order to show the underside of the hinge.

FIGS. 1–3 depict a vacuum seed meter 10 which is shown and described in greater detail in the previously referred to co-pending application of Lundie et al. The seed meter 10 has a generally cylindrical housing 12 which is comprised of a first half shell 14 and a mating second half shell 16. The half shells 14 and 16 are pivotally coupled to each other by a self-centering hinge 18 in accordance with the invention.

As described in detail hereafter the self-centering hinge 18 includes a spaced-apart pair of lugs 20 and 22 mounted on the first half shell 14 at the outer periphery thereof and a single lug 24 mounted on the outer periphery of the second half shell 16. The single lug 24 is pivotally coupled to the lugs 20 and 22 by a pin 26. A spring 28 is coupled to the pin 26 and to the first half shell 14 to provide the hinge 18 with resilient flexibility as described hereafter.

The cylindrical housing 12 which is shown in the open position in FIG. 1 is shown in the closed position in FIGS. 2 and 3. The cylindrical housing 12 is held in the closed position by a clasp 30 mounted at the outer periphery of the first half shell 14 opposite the hinge 18. The clasp 30 consists of a wire bracket 32 pivotalaly coupled to the first half shell 14 and having a roller 34 rotatably mounted at an intermediate portion of the wire bracket 32. The roller 34 is adapted to roll over and engage a lip 36 (shown in FIG. 2) formed adjacent the outer periphery of the second half shell 16 opposite the hinge 18 in order to latch the first half shell 14 to the second half shell 16.

As shown in FIG. 1 the first half shell 14 has a generally circular lip 38 at the outer periphery thereof. The lip 38 is formed with an upwardly extending flange 40 at a portion thereof opposite the hinge 18 and adjacent the clasp 30. The circular lip 38 is also formed with two additional flanges 42 and 44 at opposite sides thereof intermediate the hinge 18 and the clasp 30. In like fashion the second half shell 16 is provided with a circular lip 46 formed with a flange 48 at a portion thereof opposite the hinge 18 and adjacent the lip 36 which receives the roller 34 of the clasp 30 when the cylindrical housing 12 is closed. The circular lip 46 of the second half shell 16 is also provided with flanges 50 and 52 at opposite sides thereof intermediate the hinge 18 and the flange 48. The flanges 40, 42, 44, 48, 50 and 52 are provided to aid in achieving alignment and proper fit of the second half shell 16 over the first half shell 14 when the cylindrical housing 12 is closed. The flanges 40, 42 and 44 on the circulra lip 38 of the first half shell 14 are disposed slightly radially inwardly relative to the mating flanges 48, 50 and 52 on the circular lip 46 of the second half shell 16 so as to engage and fit within the flanges 48, 50 and 52 when the second half shell 16 is closed over the first half shell 14.

The relatively precise fit provided by the flanges 40, 42, 44, 48, 50 and 52 is necessitated by the nature of the vacuum seed meter 10 and the fact that rather precise alignment and spacing of the half shells 14 and 16 is important to the proper operation of the seed disk (not shown) which is mounted at the interface between the half shells 14 and 16 and which must maintain rather precise spatial relationships with seals and other components within the cylindrical housing 12 including in particular a vacuum seal which bears against the side of the seed disk. Because of the rather precise and close fit of the flanges 48, 50 and 52 over the flanges 40, 42 and 44, it is important that the hinge 18 be self-centering. Otherwise the various flanges might not mate with one another properly or in the case of a more serious situation might begin engagement in the wrong direction as the cylindrical housing 12 is closed. At the same time it is important that a uniform close fit be provided around the entire circumference of the half shells 14 and 16 in order for the vacuum seed meter 10 to operate properly. These requirements are very difficult if not impossible to achieve using a rigid, nonflexible hinge. The resiliency provided by the spring 28 of the hinge 18 allows the hinge to flex to the extent necessary to provide the desired uniform close fit upon closing of the cylindrical housing 12. At the same time the design of the hinge 18 makes it substantially self-centering so that upon closure of the second half shell 16 onto the first half shell 14 the various flanges 40, 42, 44, 48 50 and 52 align with and properly engage one another.

The details of the self-centering hinge 18 are shown in FIGS. 4–8. It was previously noted in connetion with FIG. 1 that the pair of spaced-apart lugs 20 and 22 are mounted on the outer edge of the first half shell 14. The lug 20 has an opening therein in the form of a slot 54 at a first side 56 of the lug 20. In similar fashion the lug 22 has an opening therein in the form of a slot 58 at a first side 60 thereof. The first side 60 of the lug 22 faces in the same direction as the first side 56 of the lug 20. The slots 54 and 58 are adapated to receive opposite portions of the pin 26 therein. A central portion of the pin 26 resides within an opening in the form of a hole 62 in the lug 24 which is mounted on the second half shell 16.

The spring 28 is of generally U-shaped configuration and is comprised of a length of resilient wire having loops 64 and 66 formed therein at the opposite ends thereof. When the hinge 18 is assembled, the loop 64 is disposed adjacent the lug 20 opposite the lug 24 and encircles an end of the pin 26 just inside of a hole 68 in the pin 26. A cotter pin 70 disposed within the hole 68 on the opposite side of the loop 64 from the lug 20 holds the pin 26 in place. The end of the pin 26 opposite the hole 68 is provided with an enlarged head 72. The loop 66 of the spring 28 encircles the pin 26 at a portion of the pin 26 between the head 72 and the lug 22.

It was previously noted that the spring 28 is coupled between the pin 26 and the first half shell 14. This coupling is accomplished by a mounting post 74 which is mounted on the first half shell 14 between the lugs 20 and 22 so as to be disposed adjacent the lug 24 on the opposite side of the pin 26 from the first sides 56 and 60 of the lugs 20 and 22. The spring 28 extends from the pin 26 in a direction opposite the first sides 56 and 60 so that an intermediate portion 76 of the spring 28 resides within a groove 78 in the mounting post 74.

The slots 54 and 58 within the lugs 20 and 22 allow the pin 26 to move about rather freely therein to permit flexing of the hinge 18. The spring 28 normally holds the pin 26 under tension against the inner walls of the slots 54 and 58. However, if it becomes necessary to flex the hinge 18 so that the common central axis of the slots 54 and 58 forms an angle with rather than coinciding with the central axis of the hole 62 within the lug 24, then such motion is permitted by the slots 54 and 58 which are considerably larger than the outer diameter of the pin 26. The spring 28 tends to pull the pin 26 and the lug 24 which is mounted thereon toward the mounting post 74 which forms a part of the first half shell 14 so as to tend to keep the pin 26 seated within the slots 54 and 58. When the second half shell 16 is swung onto the first half shell 14 to close the cylindrical housing 12 and the various flanges 40, 42, 44, 48, 50 and 52 are properly engaged with one another, the mounting post 74 on the first half shell 14 is moved slightly upwardly or away from the lug 24 which is mounted on the second half shell 16 and which holds the pin 26 therein. This bends the spring 28 slightly against the resilient resistance thereof so as to maintain a slight tension between the half shells 14 and 16 at the hinge 18. This tension combines with the action of the clasp 30 at the opposite side of the cylindrical housing 12 to insure the close uniform contact that is desired around the entire circumference of the housing 12. It also eliminates at least half the slop or tolerance present in most hinges.

It will be seen that the particular design of the hinge 18 enables limited movement of the second half shell 16 relative to the first half shell 14 in virtually any direction. This coupled with the resiliency of the spring 28 enables the hinge 18 to operate in self-centering fashion and to thereafter maintain close uniform contact between the opposite shells 14 and 16 as just described.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A hinge for resiliently pivotally coupling a first member to a second member comprising the combination of:

a first lug arrangement adapted to be mounted on the first member and having at least one opening therein;

a second lug arrangement adapted to be mounted on the second member and having an opening therein;

a pin residing within the openings in the first and second lug arrangements, the pin being smaller than the at least one opening in the first lug arrangement to permit movement thereof relative to the first lug arrangement in a plurality of different directions; and a resilient member coupled to the pin and adapted to be coupled to the first member.

2. The invention set forth in claim 1, wherein the resilient member comprises an element of resilient material having opposite ends coupled to opposite ends of the pin and an intermediate portion coupled to the first member.

3. The invention set forth in claim 2, wherein the element of resilient material comprises a generally U-shaped length of resilient wire, having a pair of leg portions on opposite sides of the intermediate portion, the leg portions being generally parallel to each other and extending in a common direction, and wherein the pin is movable relative to the first lug arrangement in the common direction of the pair of leg portions and in a plurality of directions different from the common direction.

4. The invention set forth in claim 1, wherein the opening in the second lug arrangement comprises a hole and the at least one opening in the first lug arrangement comprises a slot having opposite leg portions extending to an open end generally opposite the resilient member, the pin having a generally uniform diameter and the distance between the opposite leg portions of the slot being substantially greater than the generally uniform diameter of the pin.

5. The invention set forth in claim 1, further including a mounting post adapted to be coupled to the first member, the mounting post receiving a portion of the resilient member.

6. The invention set forth in claim 5, wherein the first lug arrangement comprises a pair of spaced-apart lugs, each having a slot therein for receiving opposite portions of the pin at a first side of the first lug arrangement, each of the slots having opposite leg portions extending to an open end generally opposite the resilient member, the pin having a generally uniform diameter and the distance between the opposite leg portions of each slot being substantially greater than the generally uniform diameter of the pin, th second lug arrangement comprises a single lug disposed between the pair of spaced-apart lugs of the first lug arrangement and having a hole therein for receiving the pin and the mounting post is disposed adjacent the pair of spaced-apart lugs of the first lug arrangement on a second side of the first lug arrangement opposite the first side thereof.

7. The invention set forth in claim 6, wherein the mounting post has a groove in a portion thereof opposite the pair of spaced-apart lugs of the first lug arrangement and the resilient member comprises a generally U-shaped element of resilient wire having an intermediate portion residing within the groove in the mounting post and opposite looped ends which encircle the pin on opposite sides of the pair of spaced-apart lugs of the first lug arrangement from the single lug of the second lug arrangement.

8. An arrangement for temporarily coupling opposite mating first and second members together comprising:

a clamp extending between and releasably coupling the first and second members together at a first portion of each, the first and second members defining a generally planar interface therebetween when coupled together; and a hinge extending between and resiliently pivotally coupling the first and second members together at a second portion of each opposite the first portion, the hinge comprising a first lug arrangement mounted on the first member and having an opening therein, a second lug arrangement mounted on the second member and having an opening therein, a pin residing within the openings in the first lug arrangement and the second lug arrangement, and means for permitting resiliently restrained movement of the pin away from the first lug arrangement and the first member in a direction generally perpendicular to the generally planar interface, the openings in the first lug arrangement being larger than the pin so as to permit movement of the pin within the openings in the first lug arrangement in a direction generally parallel to the generally planar interface.

9. The invention set forth in claim 8, wherein the means for permitting resiliently restrained movement of the pin comprises a resilient wire element having opposite ends coupled to opposite portions of the pin and an intermediate portion coupled to the first member.

10. A hinge comprising the combination of:

a pair of spaced-apart lugs, each having a slot therein at a first side thereof;

a single lug disposed between the pair of spaced-apart lugs and having a hole therein;

a pin residing within the slots in the pair of spaced-apart lugs and the hole in the single lug and having opposite end portions extending beyond the pair of spaced-apart lugs;

a resilient spring having opposite ends coupled to the opposite end portions of the pin and an intermediate portion therebetween, the spring extending from the pin in a direction generally opposite the first side of each of the pair of spaced-apart lugs; and a spring mounting element disposed between and coupled to the pair of spaced-apart lugs and receiving the intermediate portion of the spring, the pin being smaller than the slots in the pair of spaced-apart lugs to permit movement of the pin relative to the slots in the pair of spaced-apart lugs both in a first direction toward the spring mount element and in a second direction generally perpendicular to the first direction.

11. The invention set forth in claim 10, wherein the spring mounting element comprises a mounting post having a groove in a surface thereof opposite the pair of spaced-apart lugs for receiving the intermediate portion of the spring therein, the mounting post bing disposed adjacent the single lug, and wherein the spring is generally U-shaped and has loops at the opposite ends thereof encircling the opposite end portions of the pin.

12. The invention set forth in claim 11, wherein the pin has an enlarged head at one of the opposite end portions thereof and a hole therein at the other one of the opposite end portions thereof, and further including a cotter pin mounted in the hole in the pin.

* * * * *